United States Patent [19]

DiGiovanni

[11] Patent Number: 4,748,712

[45] Date of Patent: Jun. 7, 1988

[54] COBWEB VACUUM CLEANER

[76] Inventor: Judith DiGiovanni, 8 Heather Hills La., Glen Mills, Pa. 19342

[21] Appl. No.: 17,444

[22] Filed: Feb. 24, 1987

[51] Int. Cl.[4] ..... A47L 5/36

[52] U.S. Cl. ..... 15/327 C; 15/339

[58] Field of Search ..... 15/327 C, 339, 344

[56] References Cited

U.S. PATENT DOCUMENTS

| | | | |
|---|---|---|---|
| 1,047,164 | 12/1912 | Butenschoen | 15/327 C |
| 3,165,774 | 1/1965 | Barba | 15/327 C X |
| 3,308,608 | 3/1967 | Brimberg | 15/327 C X |
| 3,331,090 | 7/1967 | Reiber et al. | 15/327 C X |
| 4,325,162 | 4/1982 | Chambers et al. | 15/327 C |
| 4,541,142 | 9/1985 | Pudwill | 15/327 C X |

*Primary Examiner*—Chris K. Moore

*Attorney, Agent, or Firm*—Lipton & Famiglio

[57] ABSTRACT

A portable, battery operated cobweb vacuum cleaner is carried on a human's back or shoulder thereby permitting use of both hands. Extension means and other parts have an effective internal diameter whereby cobwebs do not substantially adhere to internal walls. Also, the internal walls can be coated with materials which minimize the adhesion of cobwebs.

6 Claims, 3 Drawing Sheets

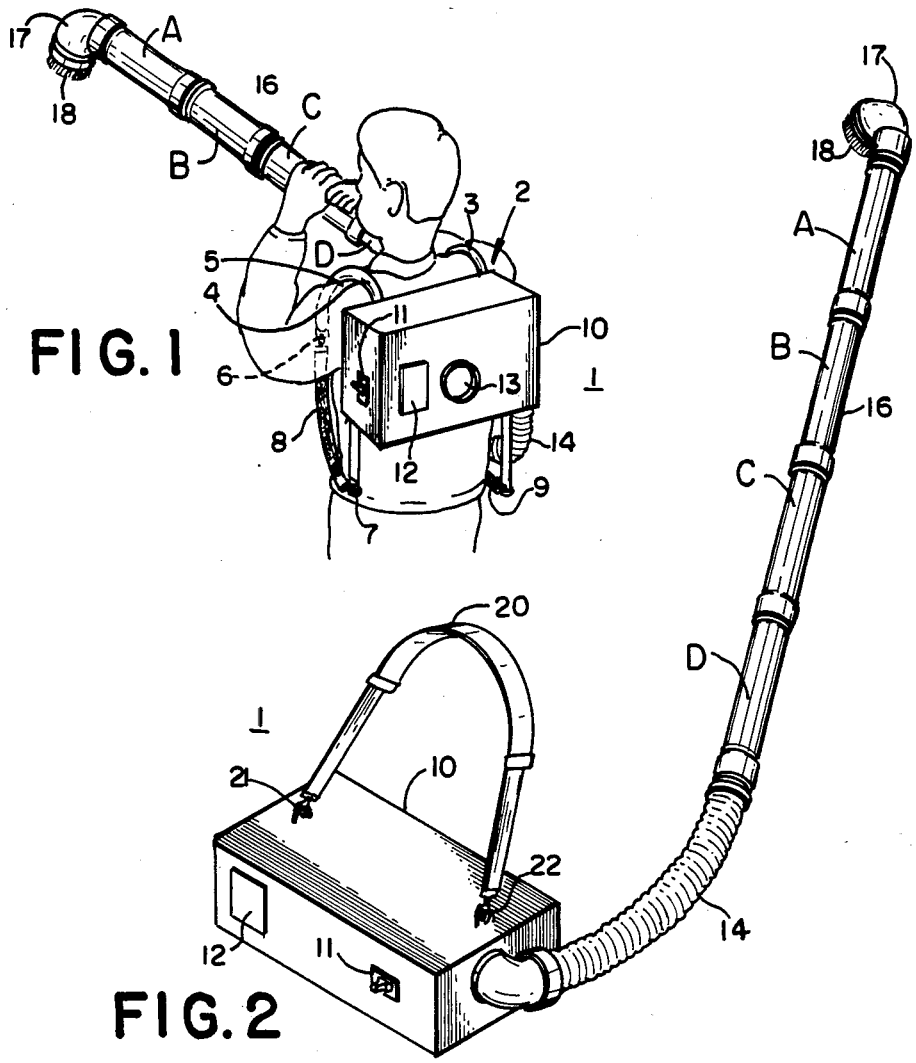
FIG. 1
FIG. 2
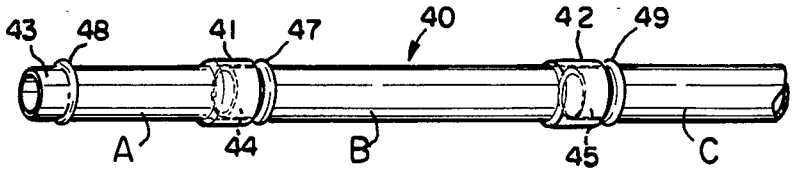
FIG. 4

COBWEB VACUUM CLEANER

BACKGROUND OF THE INVENTION

This invention relates generally to a electrically operated vacuum cleaner apparatus and particularly to a battery operated vacuum cleaner and more particularly to a portable operated vacuum cleaner.

It is an object of the present invention to provide a portable battery operated vacuum cleaner capable of being moved on a human's back or be carried by a shoulder strap thereby permitting the use of both hands. Still further it is an object of this invention to provide a portable vacuum cleaner capable of being carried up a ladder while permitting the person to hold onto the ladder.

Another object of this invention is to provide a portable vacuum cleaner which may be used either inside or outside of a building and may be carried to any location with a minimum effort and which will provide a means of cleaning high surfaces such as barn rafters.

Still another object of the present invention is to provide a portable vacuum cleaner which will be particularly useful for removing cobwebs.

Cobwebs can be particularly difficult to remove because of their ability to adhere to a surface including a cleaning tool attached to an extension device of a conventional vacuum cleaner.

Further cobwebs can adhere to the internal surface of an extension tube resulting in a decrease in the effectiveness of a vacuum cleaner or in the worst case causing plugging of the extension tube. And in a barn housing horses, it is particularly desireable to remove cobwebs because of a tendency of the cobwebs to be formed quickly and to be larger and to collect more dirt and insects.

U.S. Pat. No. 1,156,235 discloses a handheld vacuum cleaner whose motor is operated via an external power source. U.S. Pat. No. 3,267,510 discloses a portable vacuum cleaner using rechargeable batteries as a power source. U.S. Pat. No. 4,536,914 discloses a portable vacuum cleaner, which can be used in both dry and wet operations and also uses rechargeable batteries as a power source. U.S. Pat. Nos. 2,984,852; 2,134,301; 4,345,351; 4,473,918; 2,624,061; and 1,752,664 discloses various extension means for mops and dusters.

However, a problem exists in that a conventional portable vacuum cleaner has difficulty in removing a large number of cobwebs and more difficulty when the cobwebs are attached to a barn's ceiling or rafters and are associated with large quantities of debris; particularly straw, insects, soil particles and dust.

Also a portable vacuum cleaner connected by an electric cord to an external power source could have a safety problem. The walking surfaces of a barn often have wet surfaces or puddles of water. A person handling such a cleaner could step on wet surface and an unintentional grounding occur thereby injuring the handler.

SUMMARY OF THE INVENTION

The portable cobweb removal vacuum apparatus of the present invention has means for carrying the housing and other accessories on a human's back or on a strap hung over a human's shoulder. The back carrying means include such means as a back pack with attachment means to hold the housing to the back pack. The back pack can be constructed of an aluminum frame or some other suitable strong and light weight material. The housing can be permanently attached, for example, to the backpack or be attached with separation means so that the housing can be separated from the backpack. The advantage of the aforementioned carrying means is that both hands are free to clench a ladder and/or a handle of an extension hose.

Another embodiment of carrying the present invention is to have means for attaching a shoulder type strap to the housing itself. Both ends of the strap can be attached directly to the housing by, for example, turnbuckles which enables the strap to be shortened or lengthened. The strap itself can be constructed, for example, of leather, plastic, cloth, and snap or spring hooks attached to the ends of the straps which could be used to attach the strap to rings fastened to the housing.

The housing is attached to the carrying means which contains a light weight electric motor and a blower which may also be referred to as a fan or impeller. A shaft connects the motor to a blower and rotation of the shaft by the motor imparts rotation to the blower to create a partial vacuum and the accompanying suction draws air through the separation means contained in the housing. Both the blower and the shaft are constructed of known light weight materials to maintain portability.

The electric motor is driven by at least one rechargeable battery operatively adapted to provide it with electricity. The rechargeable battery is contained within the housing and can be of the type which can be removed when discharged and replaced by a charged battery. In another embodiment of the invention the rechargeable battery is capable of being recharged within the housing because means are provided for connecting said battery to an external battery charger. In still another embodiment of the invention a battery charger is contained within the housing and operationally attached to the rechargeable battery and has means for operationally attaching the battery charger to a power source.

An on/off switch is operationally connected to the rechargeable battery and the motor. In the on position the switch activates the motor thereby causing the blower to rotate and create a partial vacuum. In the off position the switch deactivates the motor. The on/off switch may be, for example, a toggle switch or an electronic pressure type.

The aforementioned separation means has an intake opening for reception of air, cobwebs, dirt, straw, dust and other kinds of debris. The separation means are operationally attached so that the blower, when rotating, causes suction at the open end of a cleaning tool attached to the one end of the extension means. The purpose of the separation means is to receive incoming air, cobwebs, dirt, straw, dust and other kinds of debris and while retaining the aforementioned solid materials and thereby permitting the separated air to pass through a discharge area to be returned to the atmosphere. Examples of separation means include, but not limited to, a bag made of paper or cloth which may be reuseable or be disposable, or a detachable canister fabricated of plastic or metal which may be washed after the removal of the solid material so that the canister can be reused many times.

One end of a flexible hose is attached to the intake opening of the separation means. The purpose of the flexible hose, which is non-collapsible, is to enable movement in any direction of the extension means which has one end attached to the hose and the other end attached to a cleaning tool. The location of the flexible hose on the housing can be anywhere on the housing, however, a preferred location for the apparatus using a back pack is on the bottom of the housing so that the flexible hose can be under the shoulder rather then over the shoulder. The under shoulder position can be more comfortable to the user.

The flexible hose attachment to the housing and hence to the intake opening of the separation means can be, for example, a ball and socket type joint which enables complete rotational movement of the hose.

One end of the extension means is attached to one end of the flexible hose. Generally the purpose of the extension means is to permit the reaching, and therefore cleaning, of high ledges and rafters existing in barns and like housing. The extension means can be, for example, several separate hollow tube sections with each tube section having a larger diameter end and a smaller diameter end whereby the smaller diameter end of one tube fits into the larger diameter end of a second tube thereby enabling the two sections to be connected together in an air tight manner. Thus, if each tube section is four feet long, connection of two sections results in extension means of eight feet long; still further five sections, a twenty foot long extension. Another example of the extension means is to have a plurality of hollow telescoping extension sections wherein the section of the largest diameter fits with the flexible hose while the section of the smallest diameters fits the cleaning tool. Another example of the extension means is to have tubular sections which have on one end internal threads and the other end external threads so that the mating sections can be screwed together.

The extension means are constructed of a light weight material such as a plastic, plastic impregnated glass or carbon fibers, or a light weight metal such as aluminum or titanium. Because of the possible length of the extension means and the length of time required to clean a barn, it is desireable that the said extension have as minimum a weight as possible in order to maintain its portability.

A preferred embodiment of the present invention is that the flexible hose and extension means both have an effective internal diameter in that the cobwebs do not substantially adhere to the internal walls of either the hose or the extension means, particularly where sections are joined together. The effective internal diameter depends in part on the amount of vacuum created by the blower and the output of the motor as to the number of revolutions per minute of the shaft connecting the motor and blower. The relationship between the variables can be easily determined by one skill in the art without undue experimentation. Another embodiment involves coating the internal walls of both the flexible hose and the extension means with a material which minimizes the adnesion of any cobwebs to the internal walls. Such coating materials are known and one general example is the fluorine containing plastics and in particular the polytetrafluoroethylenes.

BRIEF DESCRIPTION OF THE DRAWINGS

The foregoing aspects and other features of this invention are explained in the following description taken in connection with the accompanying drawings herein:

FIG. 1: is a schematic view of the apparatus of the present invention involving a backpack;

FIG. 2: is a schematic view of the apparatus of the present invention using a shoulder strap;

FIG. 4: is a schematic view of the extension means; and

DETAILED DESCRIPTION OF THE DRAWING

Figure 3A:
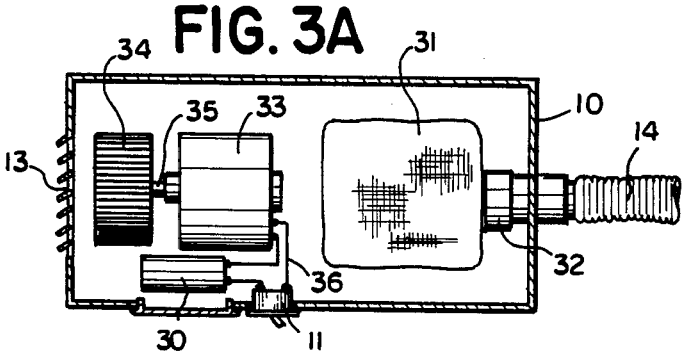
FIG. 3: is a schematic view of the internal means of the apparatus of three embodiments.

With reference to FIG. 1, there is shown the apparatus 1 of the present invention. In this embodiment backpack 2 consists of two shoulder hooks, 3 & 4, which hook over a human's shoulder 5. A shoulder hook consists of one piece of tubing with a curved section and a straight section. End 6, of the curved section shoulder hook 4 is connected to the other end 7 of the straight section of shoulder hook 4 by a strap 8 which helps hold the pack firmly on the back. Strap 8 has adjustable means (not shown) which enable the strap 8 to be adjusted to fit the body. Another strap 9 connects the ends of the other shoulder hook 3.

The housing 10, containing the vacuum cleaner components, is attached to the shoulder hooks 3 & 4 by known fasteners (not shown), for example, welding, a nut and bolt, clip and other known devices.

The housing 10 also contains an on/off switch 11 which activates/deactivates the motor (not shown) contained in the housing 10. While the switch 11 is shown located at one position on the housing, it could be located elsewhere on the housing 10. Further in this particular embodiment, by lifting cover 12, the rechargeable battery (not shown) can be removed and replaced. In another embodiment electrical means, such as an electrical socket (not shown), would replace cover 12 and permit operational connection of an external battery charger to the housing via a suitable electric cord (not shown). In another embodiment the housing could contain a battery charger and the electrical plug could permit an external power source to be connected to the battery charger via a suitable electric cord (not shown).

The housing 10 also contains an air discharge area 13 from which air, drawn in at the end of the cleaning tool 17 and separated in the separation means (not shown) contained in the housing, can be discharged to the atmosphere.

Also connected to the housing 10 is a flexible hose 14 which because of its flexibility can be formed into any convenient shape in order to permit the widest movement of extension means 16. The construction of one embodiment extension means which can be used with the present invention is detailed in FIG. 4. In FIG. 1 extension means 16 consists of four sections, A,B,C AND D. The latter section, D, is connected (not shown) to flexible hose 14. At the end of section A is cleaning tool 17 with bristles 18. Various kinds of cleaning tools are known, however, with this invention the bristles of any brush type tool are preferable relatively short and hard.

FIG. 2 shows another embodiment of present invention. Apparatus 1 is connected to a shoulder strap 20 which is connected to housing 1 by fasteners 21 & 22. Off/on switch 11, and cover 12 works as previously described in connection with FIG. 1. Flexible hose 14, is connected to both housing 10 and section D of extension means 16. Extension means 16 in FIG. 2 consists of four sections A,B,C & D and attached to one end of section A is cleaning tool 17 with short hard bristles 18.

Figure 3B:
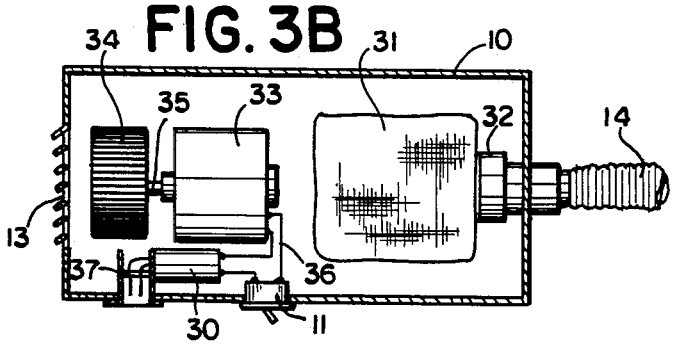
Figure 3C:
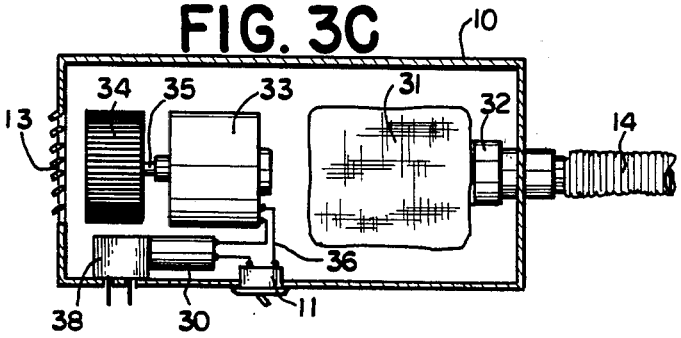

FIG. 3 discloses the internal means of housing 10 containing the internal components of the apparatus 1. In embodiment A housing 10 contains a rechargeable battery 30 of the type which is removed from the housing 10 when it becomes discharged. It can be replaced by another charged battery or the discharged battery is recharged externally and then replaced back in the housing 10. Flexible hose 14 enters separation means 31 which has an inlet 32 which fits substantially air tight around the external surface of flexible hose 14. Separation means 31 can be constructed of a cloth of sufficient weave to permit passage of air but retains within its confines the solid particles entering through flexible hose 14. Motor 33 is connected to a blower 34 by shaft 35 which rotates blower 34 when on/off switch 11 is placed in an on position which activates motor 33. On/-off switch 11 is operationally connected to both the motor 33 and the rechargeable battery 30 by electrical means 36. When blower 34 is rotating air is blown out of the housing 10 through air discharge area 13 creating a partial vacuum in separation means 31 and through flexible hose 14 and extension means 16 and to the end of cleaning tool 17.

FIG. 3, embodiment B contains electrical means 37 which is operationally attached to the battery 30 and which permits battery 30, while remaining in the housing 10, to be electrically connected on external battery charger (not shown). The external battery charger can be juxtaposed to the housing 10 at means 37 or located near a power source and connected via an electrical connector or cord to means 37.

FIG. 3, embodiment C contains battery charger 38, which is operationally attached to battery 30. When battery charger 38 is operationally attached to a power source it then recharges battery 30.

FIG. 4, extension means 40 consists of sections of tubes A,B and C. Each section has one larger diameter end 41 and 42 and one smaller diameter end 43, 44 and 45, which fits inside the larger diameter ends. Thus, as an example smaller diameter 44 of section B fits inside larger diameter 41 of section A. In the embodiment shown in FIG. 4 the smaller diameter end has a relatively small ridge, 47,48 and 49 located a relatively short distance from its end. The purpose of the small ridges 47, 48 and 49 is to provide a stoppage means so that, for example, smaller diameter 44 is not jammed too far into larger diameter end 41 thereby causing a problem when it is desired to separate the sections A, B and C.

Other backpack means for carrying the vacuum cleaner on one's back include, but not limited to, what campers generally refer to as an external frame pack.

Figure 5A:
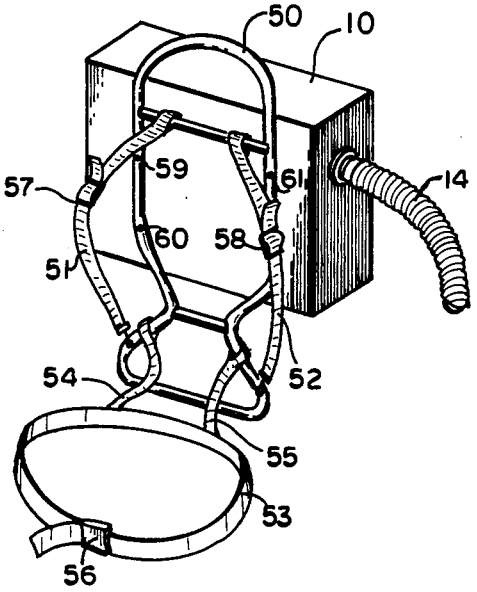
FIG. 5: is a schematic view of three embodiments of rigid back pack means.
Figure 5B:
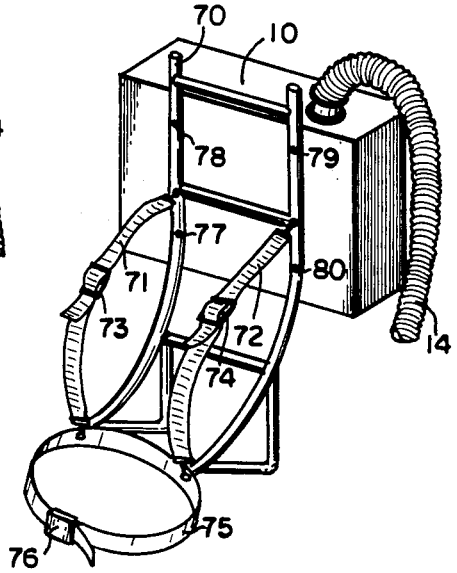
Figure 5C:
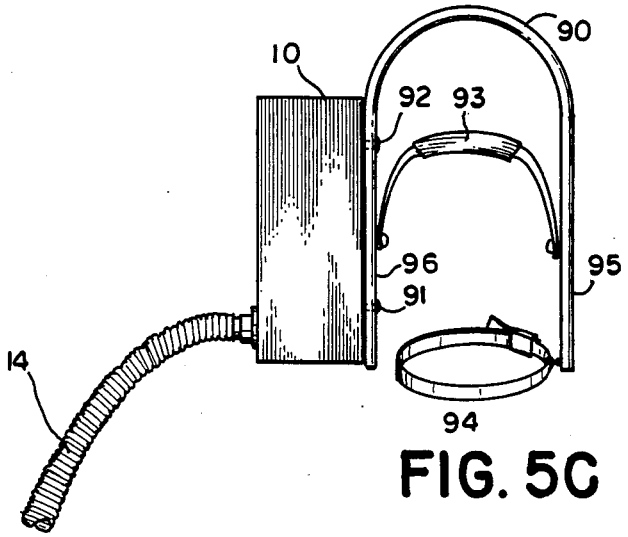

FIG. 5, discloses three embodiments of rigid, external frame packs. Embodiment A shows extension hose 14 attached to one side of housing 10. Attached to the rigid frame 50 are a pair of houlder straps 51 & 52 of which one pair of ends are attached towards the bottom of frame 50. Belt 53 is attached to frame 50 by attachments 54 and 55. Buckle 56 permits adjustment of the belt 53 to fit individual waists. Shoulder straps 51 & 52 have adjustment means 57 and 58 to permit adjustment to fit individual configurations. Attachments means 59, 60 ,61 (and another one which is not shown) provide means for attaching housing 10 to frame 50.

Embodiment B shows extension hose 14 attached to the top of housing 10 which is attached to rigid frame, 70 along with a pair of shoulder straps 71 & 72 having adjustable means 73 & 74. One pair of the ends of the straps 71 & 72 are attached to the frame 70 near its top while the other pair of strap ends are attached to the ends of the frame 70 which fit around one's waist. Attached to the latter is a belt 75 which fits around one's waist and has adjustable means 76. Attachment means 77,78,79 and 80 attach the housing 10 to the frame 70. These means can be detachable in that the housing 10 can be separated from frame 70 if so desired. The attachment means can also be of a permanent type, i.e., the housing 10 is spot welded to the frame 70.

Embodiment C shows extension hose 14 attached to the back of housing 10 which is attached to frame 90 by means 91 & 92. Embodiment C consists of two frames 90 but only one is shown. One of the frames 90 fits over one's right shoulder while the other frame fits over one's left shoulder. Attach to about the middle of frame 90 are shoulder straps 93 (only one shown) which rests on one's shoulders. Towards the bottom of frame 90 is belt 94 which is attached to the front ends of legs 95 (only one shown) of frame 90. Optionally belt 94 can be attached to the back legs 96 (only one shown). The advantage of embodiment C is that the entire apparatus may be placed on the ground in an upright position.

Another embodiment of carrying means (not shown) includes a pair of strap attachments to the housing and which straps fit over one's shoulders and under back to the housing. The housing then rests on one's back. A belt may also be directly attached to the housing and attached to the shoulder straps.

Although the present invention has been described in particular embodiments herein set forth, it is to be understood that the present disclosure has been made only by way of example and that numerous changes in the details of construction may be resorted to without departing in the spirit and scope of the invention. Thus, the scope of the invention should not be limited by the foregoing specifications, but rather only by the scope of the following claims of the invention.

What is claimed is:

1. A portable cobweb removal vacuum apparatus comprising:

(a) means for carrying said apparatus on a human;

(b) a housing attached to said carrying means and containing;

(1) an electric motor;

(2) a blower driven by said electric motor whereby rotation of said blower produces a vacuum;

(3) a removable separation means having an intake opening for reception of solid particles and air drawn into said intake opening in response to a vacuum developed by said blower, and having a discharge area for the discharge of outgoing separated air;

(4) at least one rechargeable battery adapted to provide power for said electric motor;

(5) an on-off switch operationally connected to said motor and said battery and which switch activates and deactivates said motor;

(c) a flexible hose, having an internal coating which substantially minimizes the adhesion of cobwebs, attached to the intake opening of separation means;

(d) extension means, having an internal coating which substantially minimizes the adhesion of cobwebs; attached to the flexible hose and having means for attaching thereto a cleaning tool; and (e) a cleaning tool having means for attachment to said extension means.

2. Apparatus according to claim 1 wherein said rechargeable battery is removable.

3. Apparatus according to claim 1 wherein the housing additionally contains means for connecting said rechargeable battery to an external battery charger.

4. Apparatus according to claim 1 wherein the housing additionally contains a battery charger operationally attached to said rechargeable battery and containing means whereby said battery charger can be operationally attached to a power source so that when said battery charger is opertionally attached to said power source, said battery charger recharges said rechargeable battery.

5. Apparatus according to claim 1 wherein the separation means is selected from the group consisting of a cloth separation bag, a paper separation bag, and a canister.

6. A portable cobweb removal vacuum apparatus comprising:

(a) means for carrying said apparatus on a human;

(b) a housing attached to said carrying means and containing:

(1) an electric motor;

(2) a blower driven by said electric motor whereby rotation of said blower produces a vacuum;

(3) a removable separation means having an intake opening for reception of solid particles and air drawn into said intake opening in response to a vacuum developed by said blower, and having a discharge area from the discharge of outgoing separated air, and wherein the separation means is selected from the group consisting of a cloth separation bag, a paper separation bag, and a canister;

(4) at least one rechargeable battery adapted to provide power for said electric motor and wherein the housing contains means for connecting said rechargeable battery to an external battery charger;

(5) an on-off switch opertionally connected to said motor and said battery and which switch activates and deactivates said motor;

(c) a flexible hose attached to the intake opening of said separation means; said hose having an effective internal diameter whereby cobwebs do not substantially adhere to its internal walls; and having an internal coating which substantially minimizes the adhesion of cobwebs;

(d) extension means attached to the flexible hose and having means for attaching thereto a cleaning tool and said extension means are constructed of a strong, light weight material; said extension means having an effective internal diameter whereby cobwebs do not substantially adhere to its internal walls; and having an internal coating which substantially minimizes the adhesion of cobwebs; and (e) a cleaning tool having means for attachment to said extension means, said tool having an effective internal diameter whereby cobwebs do not substantially adhere to its internal walls, and having an internal coating which substantially minimizes the adhesion of cobwebs.

* * * * *